US009771540B2

(12) United States Patent
Young et al.

(10) Patent No.: US 9,771,540 B2
(45) Date of Patent: Sep. 26, 2017

(54) HYDRAULIC OIL COMPOSITIONS WITH IMPROVED HYDRAULIC MOTOR EFFICIENCY

(71) Applicants: Tomasz M. Young, Philadelphia, PA (US); David G. L. Holt, Medford, NJ (US); Angela S. Galiano-Roth, Mullica Hall, NJ (US); Allan R. Barber, Belper (GB); Brian B. Filippini, University Heights, OH (US)

(72) Inventors: Tomasz M. Young, Philadelphia, PA (US); David G. L. Holt, Medford, NJ (US); Angela S. Galiano-Roth, Mullica Hall, NJ (US); Allan R. Barber, Belper (GB); Brian B. Filippini, University Heights, OH (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 150 days.

(21) Appl. No.: 14/547,228

(22) Filed: Nov. 19, 2014

(65) Prior Publication Data

US 2015/0072909 A1 Mar. 12, 2015

Related U.S. Application Data

(63) Continuation-in-part of application No. 13/145,166, filed on Aug. 11, 2011.

(Continued)

(51) Int. Cl.
*C10M 141/10* (2006.01)
*C10L 1/22* (2006.01)

(Continued)

(52) U.S. Cl.
CPC ..... *C10M 133/46* (2013.01); *C10M 137/02* (2013.01); *C10M 141/10* (2013.01);

(Continued)

(58) Field of Classification Search
CPC ..... C10M 133/16; C10M 137/04; C10M 2223/049

(Continued)

(56) References Cited

U.S. PATENT DOCUMENTS 3,636,603 A 1/1972 Moss et al.
3,939,084 A * 2/1976 Sullivan ..... C09K 3/00 252/391

(Continued)

FOREIGN PATENT DOCUMENTS

CA 1188704 A1 6/1985
WO 92/19703 A1 11/1992

(Continued)

OTHER PUBLICATIONS

The International Search Report and Written Opinion of PCT/US2015/058034 dated Feb. 11, 2016.

(Continued)

*Primary Examiner* — Prem C Singh
*Assistant Examiner* — Francis C Campanell
(74) *Attorney, Agent, or Firm* — Robert A. Migliorini

(57) ABSTRACT

The present invention relates to methods of lubricating a hydraulic motor by using a lubricating composition that contains a friction modifier selected from the group consisting of a fatty phosphite, a fatty imidazoline and combinations thereof and supplies improved motor efficiency performance. The invention further provides the lubricating compositions used therein.

13 Claims, 3 Drawing Sheets

Related U.S. Application Data

(60) Provisional application No. 61/145,790, filed on Jan. 20, 2009.

(51) Int. Cl.
*C10M 133/46* (2006.01)
*C10M 137/02* (2006.01)

(52) U.S. Cl.
CPC ..... *C10M 2203/1025* (2013.01); *C10M 2205/0285* (2013.01); *C10M 2205/173* (2013.01); *C10M 2215/224* (2013.01); *C10M 2223/045* (2013.01); *C10M 2223/049* (2013.01); *C10N 2230/06* (2013.01); *C10N 2230/24* (2013.01); *C10N 2240/08* (2013.01)

(58) Field of Classification Search
USPC ..... 508/421, 551
See application file for complete search history.

(56) References Cited

U.S. PATENT DOCUMENTS

| | | | |
|---|---|---|---|
| 4,210,541 | A | 7/1980 | Mann |
| 4,419,251 | A | 12/1983 | Shim et al. |
| 4,419,252 | A | 12/1983 | Shim |
| 4,466,894 | A | 8/1984 | Grover |
| 4,579,672 | A | 4/1986 | Brecker et al. |
| 4,582,618 | A | 4/1986 | Davis |
| 4,622,158 | A | 11/1986 | Walsh |
| 4,741,848 | A | 5/1988 | Koch et al. |
| 4,752,416 | A | 6/1988 | Scharf et al. |
| 4,792,410 | A | 12/1988 | Schwind et al. |
| 4,957,651 | A | 9/1990 | Schwind |
| 4,959,168 | A | 9/1990 | Schroeck |
| 5,110,488 | A | 5/1992 | Tipton et al. |
| 5,262,073 | A | 11/1993 | Schmitt et al. |
| 6,251,840 | B1 * | 6/2001 | Ward, Jr. ..... C10M 161/00 252/75 |
| 6,583,092 | B1 | 6/2003 | Carrick et al. |
| 6,677,281 | B2 | 1/2004 | Givens, Jr. et al. |
| 7,014,694 | B1 | 3/2006 | Miksic et al. |
| 7,820,602 | B2 | 10/2010 | Ravichandran et al. |
| 2006/0135379 | A1 | 6/2006 | Buitrago |
| 2007/0066495 | A1 | 3/2007 | Macpherson |
| 2010/0162693 | A1 | 7/2010 | Michael et al. |
| 2011/0287989 | A1 | 11/2011 | Filippini |

FOREIGN PATENT DOCUMENTS

| | | | |
|---|---|---|---|
| WO | 93/03121 | A1 | 2/1993 |
| WO | 96/35765 | A1 | 11/1996 |
| WO | 2004096959 | A1 | 11/2004 |
| WO | 2010/085434 | A1 | 7/2010 |
| WO | 2011066142 | A1 | 6/2011 |

OTHER PUBLICATIONS

Michael, Paul, "Performance and Comparison Testing of Hydraulic Fluids", Performance from Milwaukee School of Engineering, Fluid Power Institute, 2012.

* cited by examiner

HYDRAULIC OIL COMPOSITIONS WITH IMPROVED HYDRAULIC MOTOR EFFICIENCY

CROSS-REFERENCE TO RELATED APPLICATIONS

This is a Continuation-In-Part application which claims priority to Non-provisional U.S. Ser. No. 13/145,166 filed on Jan. 18, 2010, which claims priority to Provisional Application U.S. Ser. No. 61/145,790 filed on Jan. 20, 2009, both of which are herein incorporated by reference in their entirety.

FIELD OF INVENTION

The present invention relates to methods of lubricating a hydraulic motor by using a lubricating composition that contains a friction modifier and supplies improved motor efficiency performance. The invention further provides the lubricating compositions used therein.

BACKGROUND OF THE INVENTION

Low starting efficiency of low-speed high-torque (LSHT) hydraulic motors is a well-recognized and significant limitation of hydraulic motors. Both OEMs and end-users are interested in improvements to this property, and in particular, hydraulic oil compositions for use in hydraulic motors which would yield improvements in starting efficiency of low-speed high-torque (LSHT) hydraulic motors.

It is known to employ a metal containing antiwear agent, such as a zinc containing antiwear agent, in a lubricating composition suitable for a hydraulic system, circulating oil or another industrial oil. However such agents may form deposits such as resins, sludge and varnish in the hydraulic system. These deposits impair the performance of the hydraulic systems by causing valve sticking and unresponsive control. Additionally, the cleaning of these systems is difficult since the deposits are difficult to remove without mechanical abrasion.

International publication WO96/035765 discloses a lubricating composition with a rust reducing or preventing amount of 0.1 to 3 wt % of a metal synthetic aryl sulfonate and 0.01 to 2 wt % of an aliphatic succinic acid or anhydride. Further the use of substituted polyisobutylene succinic acid or anhydride derivatives of polyol esters or polyamines are excluded because lubricating compositions that contain said additive do not exhibit acceptable rust resistance properties.

U.S. Pat. Nos. 4,419,251 and 4,419,252 disclose aqueous lubricants with oil-in-water characteristics containing a dispersant/emulsifier system and an antiwear/rust inhibiting package.

U.S. Pat. No. 5,262,073 discloses a lubricating composition containing a zinc dispersant, 0.3 to 1 wt % of calcium nonyl di-naphthalene synthetic sulfonate detergent and 0.09 to 0.85 wt % of calcium alkylphenate.

U.S. Pat. No. 6,677,281 discloses a lubricating composition containing a metal sulfonate, an ashless alkenyl succinimide and a borated polyolefin dispersant.

U.S. Pat. No. 4,466,894 discloses a composition containing metal salts of phosphorus thio-alcohols, a sulfurized phenate, and a benzotriazole.

International publication WO 93/03121 discloses a metal salt of at least one of a sulfonate, a carboxylate and a phenate, in combination with an aliphatic carboxylic acid or anhydride thereof.

It would be desirable for a low sulfur lubricating composition to provide acceptable and/or improved anti-wear performance while also reducing and/or preventing deposit formation in the device being lubricated. It would also be desirable to for a lubricating composition to provide one or more of these improvements without negatively impacting any other performance areas, such as the demulsibility of the composition. The present invention provides a low sulfur lubricating composition with such properties and also provides a method of lubricating a device using such compositions.

It would also be desirable to provide for hydraulic oil compositions which yield improved starting efficiency of low-speed high-torque (LSHT) hydraulic motors. The present invention provides hydraulic oil compositions with specific friction modifiers, which yield a surprising and unexpected increase in starting efficiency of low-speed high-torque (LSHT) hydraulic motors.

SUMMARY OF THE INVENTION

The present invention provides hydraulic oil compositions including one or more oils of lubricating viscosity and an effective amount of friction modifier selected from the group consisting of fatty (alkyl) phosphite, alkenyl imidazoline and combinations thereof, which results in a significant increase in starting efficiency of low-speed high-torque (LSHT) hydraulic motors relative to a hydraulic oil composition not including the effective amount of friction modifier. Other friction modifiers may not yield similar improvements in starting efficiency. The invention also provides a method of lubricating hydraulic motors with such inventive hydraulic oil compositions.

More specifically, the present invention provides a hydraulic oil composition comprising: (a) one or more oils of lubricating viscosity and (b) an effective amount of a friction modifier selected from the group consisting of a fatty phosphite, a fatty imidazoline and combinations thereof, wherein the hydraulic oil composition results in at least a 2% increase in starting efficiency of low-speed high-torque (LSHT) hydraulic motors relative to the same hydraulic oil composition not including the effective amount of the friction modifier.

More specifically, the present invention also provides a method for lubricating a low-speed high-torque (LSHT) hydraulic motor requiring a hydraulic oil composition, the method comprising: supplying the low-speed high-torque (LSHT) hydraulic motor with a hydraulic oil composition comprising: (a) one or more oils of lubricating viscosity; and (b) an effective amount of a friction modifier selected from the group consisting of a fatty phosphite, a fatty imidazoline and combinations thereof, wherein the hydraulic oil composition results in at least a 2% increase in starting efficiency of low-speed high-torque (LSHT) hydraulic motors relative to the same hydraulic oil composition not including the effective amount of the friction modifier.

The invention also provides a method for lubricating a mechanical device requiring industrial fluids, hydraulic fluids, turbine oils, circulating oils, or combinations thereof, the method comprising: (I) supplying the mechanical device with a lubricating composition comprising: (a) an oil of lubricating viscosity wherein the oil is substantially free of sulfur; and (b) a friction modifier; resulting in reduced wear, reduced friction, or combinations thereof within the device.

Component (a) may comprise a group II oil, a group III oil, a gas-to-liquid oil, a poly-alpha-olefin, or combinations thereof. The lubricating composition may further comprise a dispersant, an antioxidant, a corrosion inhibitor, a carboxylic acid or anhydride, a detergent, an antiwear agent, an antifoam, a metal deactivator, a demulsifier, a detergent stabilizer, or combinations thereof.

The invention further provides for the methods described above where the lubricating composition further comprises a metal di-hydrocarbyl-substituted dithiophosphate, wherein at least one hydrocarbyl group is a branched primary hydrocarbyl group.

The invention further provides for the methods described above where the lubricating composition further comprises a metal-free di-hydrocarbyl-substituted dithiophosphate, wherein at least one hydrocarbyl group is a branched primary hydrocarbyl group.

The invention further provides for the lubricating composition being prepared by adding the friction modifiers described herein as an aftermarket treatment to the oil of lubricating viscosity and/or a formulated hydraulic fluid.

The invention also provides for a lubricating composition comprising: (a) an oil of lubricating viscosity wherein the oil is substantially free of sulfur; (b) a friction modifier; (c) a dispersant; (d) a metal di-hydrocarbyl-substituted dithiophosphate, wherein at least one hydrocarbyl group is a branched primary hydrocarbyl group; and (e) optionally a viscosity index improving polymer.

The invention also provides for a lubricating composition comprising: (a) an oil of lubricating viscosity wherein the oil is substantially free of sulfur; (b) a friction modifier; (c) a metal-free di-hydrocarbyl-substituted dithiophosphate, wherein at least one hydrocarbyl group is a branched primary hydrocarbyl group; (d) an antioxidant; and (e) optionally a viscosity index improving polymer.

DETAILED DESCRIPTION OF THE INVENTION

Figure 1:
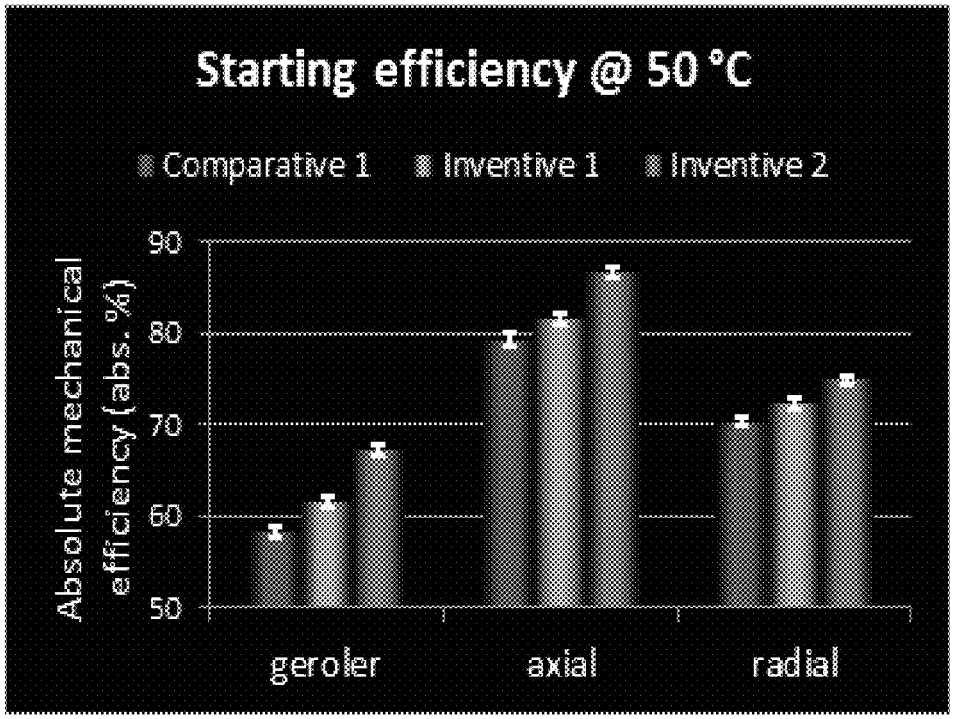
FIG. 1 depicts the measured absolute starting efficiency for 3 different hydraulic motors at 50 degrees C. with 2 inventive friction modifiers and a comparative reference with no friction modifier.

The Applicants have discovered that hydraulic oil compositions with specific friction modifiers yield a surprising and unexpected increase in starting efficiency of low-speed high-torque (LSHT) hydraulic motors. The unexpected and surprising improvement of start-up efficiency for the inventive hydraulic fluids is notable because start-up efficiency gets attention of both OEMs and end users of hydraulic systems. Certain applications are significantly impacted by low efficiency (e.g. skid-steer loaders, cement mixers, asphalt rollers and excavators). Improved efficiency may also allow for the whole hydraulic system to be smaller. The changes could include a use of a less powerful primary mover (e.g. diesel engine in mobile application) and hydraulic pump. Downsizing of these components allows for reduced energy consumption, resulting in significant savings over the lifetime of the equipment which could be especially pronounced in mobile applications where the weight of the vehicle contributes to fuel consumption during driving. The efficiency of hydraulic motors may be improved to a point where it may help enable novel use of hydraulics in applications such as hydrostatic hybrid vehicle drives and wind turbines. In these applications efficiency of the motor is critical and is viewed as a bottle neck. All numerical values within the detailed description and the claims herein are modified by "about" or "approximately" the indicated value, and take into account experimental error and variations that would be expected by a person having ordinary skill in the art.

The present invention provides hydraulic oil compositions including one or more oils of lubricating viscosity and an effective amount of friction modifier selected from the group consisting of a fatty phosphite, a fatty imidazoline and combinations thereof, which results in a significant increase in starting efficiency of low-speed high-torque (LSHT) hydraulic motors relative to a hydraulic oil composition not including the effective amount of friction modifier. The invention also provides a method of lubricating hydraulic motors with such inventive hydraulic oil compositions.

In one form of the instant disclosure, a hydraulic oil composition is provided which includes: (a) one or more oils of lubricating viscosity and (b) an effective amount of a friction modifier selected from the group consisting of a fatty phosphite, a fatty imidazoline and combinations thereof, wherein the hydraulic oil composition results in at least a 2% increase in starting efficiency of low-speed high-torque (LSHT) hydraulic motors relative to the same hydraulic oil composition not including the effective amount of the friction modifier.

In another form of the instant disclosure, method for lubricating a low-speed high-torque (LSHT) hydraulic motor requiring a hydraulic oil composition is provided wherein, the method includes: supplying the low-speed high-torque (LSHT) hydraulic motor with a hydraulic oil composition comprising: (a) one or more oils of lubricating viscosity; and (b) an effective amount of a friction modifier selected from the group consisting of a fatty phosphite, a fatty imidazoline and combinations thereof, wherein the hydraulic oil composition results in at least a 2% increase in starting efficiency of low-speed high-torque (LSHT) hydraulic motors relative to the same hydraulic oil composition not including the effective amount of the friction modifier.

The hydraulic oil composition of the instant disclosure alternatively results in at least a 4%, or 5%, or 6%, or 8%, or 10% increase in starting efficiency of low-speed high-torque (LSHT) hydraulic motors relative to the same hydraulic oil composition not including the effective amount of the friction modifier.

Non-limiting exemplary low-speed high-torque (LSHT) hydraulic motors suitable for use with the hydraulic oil compositions of the instant disclosure are of the geroler type, the bent axial piston type and the radial piston type. The hydraulic oil compositions of the instant disclosure are suitable for lubricating metal to metal contact surfaces and also metal to plastic contact surfaces of such low-speed high-torque (LSHT) hydraulic motors.

A list of friction modifiers suitable for the invention includes: (i) fatty phosphites; (ii) fatty imidazolines; and combinations thereof. For instance, (i) fatty phosphites are generally of the formula $(RO)_2PHO$. In one embodiment, the dialkyl phosphite, as shown in the preceding formula, is typically present with a minor amount of monoalkyl phosphite of the formula (RO)(HO)PHO. In these structures, the term "R" is conventionally referred to as an alkyl group. It is, of course, possible that the alkyl is actually alkenyl and thus the terms "alkyl" and "alkylated," as used herein, will embrace other than saturated alkyl groups within the phosphite. The phosphite should have sufficient hydrocarbyl groups to render the phosphite substantially oleophilic. In some embodiments, the hydrocarbyl groups are substantially unbranched. Many suitable phosphites are available commercially and may be synthesized as described in U.S. Pat. No. 4,752,416. In some embodiments, the phosphite contains 8 to 24 carbon atoms in each of R groups. In other embodiments, the fatty phosphite contains 12 to 22 carbon atoms in each of the fatty radicals, and in yet other embodiments, the fatty phosphite contains 16 to 20 carbon atoms. In one embodiment, the fatty phosphite can be formed from oleyl groups, thus having 18 carbon atoms in each fatty radical.

Alkyl-substituted imidazolines are also well known materials. They can generally be formed by the cyclic condensation of a carboxylic acid with a 1,2 diaminoethane compound. They generally have the structure

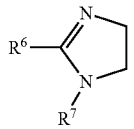

where $R^6$ is an alkyl group and $R^7$ is hydrogen or a hydrocarbyl group or a substituted hydrocarbyl group, including —(CH2CH2NH)n- groups. In one embodiment, the friction modifier is the condensation product of a C8 to C24 fatty acid with a polyalkylene polyamine, and in particular, the product of isostearic acid with tetraethylenepentamine. The condensation products of carboxylic acids and polyalkyleneamines (xiii) may generally be imidazolines or amides. They may be derived from any of the carboxylic acids described above and any of the polyamines described herein.

Among the numerous suitable carboxylic acids useful in preparing the imidazoline are oleic acid, stearic acid, isostearic acid, tall oil acids, and other acids derived from natural and synthetic sources. Carboxylic acids which may be used are those containing 12 to 24 carbon atoms including the 18 carbon acids such as oleic acid and stearic acid. Among suitable 1,2 diaminoethane compounds are compounds of the general structure R"—NH—$C_2H_4$—$NH_2$, where R" is a hydrocarbyl group or a substituted hydrocarbyl group (e.g., hydroxy hydrocarbyl, aminohydrocarbyl). In one embodiment, the diamine is N-hydroxyethyl-1,2-diaminoethane, $HOC_2H_4NHC_2H_4NH_2$. In this embodiment, the resultant alkyl-substituted imidazoline is 1-hydroxyethyl-2-heptadecenyl imidazoline. In another embodiment, the amine is diethylenetriamine and the resultant imidazoline is 1-aminoethyl-2-heptadecenyl imidazoline.

A particularly preferred fatty phosphite is a fatty alkyl phosphite. A particularly preferred fatty imidazoline is an alkenyl imidazoline.

An effective amount of friction modifier is defined as 0.005 to 2 wt. %, or 0.01 to 2 wt %, or 0.03 to 1 wt % of the lubricating composition, and in some embodiments is 0.05 to 1.5 wt %, 0.05 to 0.5 wt %, 0.08 to 1 wt %, or 0.075 to 0.3 wt %. In some embodiments, however, the amount of friction modifier is present at less than 0.5 percent or less than 0.2 percent by weight, or present from 0.2 to 0.5 percent. In other embodiments the friction modifier is present at more than 500 ppm, more than 1000 ppm, more than 1500 ppm or more than 2000 ppm, but in each of these embodiments the upper limit may be no more than 5000 ppm, no more than 3000 ppm, or no more than 2000 ppm. These ranges may apply to the amounts of individual friction modifier present in the composition or to the total friction modifier component in the compositions, which may include a mixture of two or more friction modifiers.

The hydraulic oil compositions of the instant disclosure also results in wear performance as measured by the FZG load stage test substantially the same as the same hydraulic oil composition not including the effective amount of the fatty phosphite friction modifier. As used herein the term 'substantially the same' means less than a 2%, or less than a 1%, or less than a 0.5% difference.

The present invention provides a lubricating composition and method as defined above. As used herein the term 'substantially free of' with regards to water, means the lubricating composition contains not more than contaminant amounts of water, for example, water present at less than about 1 wt %, preferably less than about 0.5 wt %, or even about 0.2 wt % or less of the lubricating composition.

It should however be noted that during application of the lubricating composition in industrial fluids, hydraulic fluids, turbine oils, circulating oils, or combinations thereof, extraneous water may be incorporated into the system. The extraneous water is not included in the contaminant amounts of water disclosed above.

In one embodiment the lubricating composition is substantially free of, to the absence of water. In one embodiment the lubricating composition is not an oil-in water emulsion.

In one embodiment the methods of the invention provide a means for improving the antiwear performance (or wear performance) of a hydraulic fluid. In another embodiment the invention provides a means for improving the antiwear performance of a low sulfur hydraulic fluid without adversely impacting the demulsibility of the fluid. In still other embodiments, the invention provides a means for improving the antiwear performance of a low sulfur hydraulic fluid containing a dispersant. In some of these embodiments the dispersant may contain metal, such as zinc. In each of the embodiments described above, the hydraulic fluids may be based on Group II or similar oils. Any of the embodiments described above may result in hydraulic fluid compositions which are zinc free, metal free, or ashless (i.e., does not contain metal in amounts greater than those associated with contaminant amounts). In still other embodiments, any of the embodiments described above may be free of viscosity modifiers, while in another set of embodiments, any of embodiments described above may further comprise a viscosity modifier.

Oils of Lubricating Viscosity

The lubricating composition comprises an oil of lubricating viscosity. Such oils include natural and synthetic oils, oil derived from hydro-cracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene isobutylene copolymers); poly(l-hexenes), poly(1-octenes), poly (1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof or mixtures thereof.

Other synthetic lubricating oils include liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group I, Group II, Group III oil or mixtures thereof.

Oils suitable for use in the invention are substantially free of sulfur, which means that the oil component contains less than 3000 ppm of sulfur, less than 1500 ppm of sulfur, or less than 1000 ppm of sulfur. In other embodiments, the oil component may contain less than 500 ppm of sulfur, less than 300 ppm of sulfur, or less than 150 ppm of sulfur. In some embodiments these limits on sulfur content may be applied to the overall lubricating composition, which may include one or more additives.

Oils suitable for use in the invention may have (i) a sulfur content of less than 0.03% wt, (ii) contain at least 90% wt saturates (iii) have a viscosity index of at least 120, or (iv) combinations thereof. In some embodiments individual oils used in the composition may not meet any of these requirements, but the total oil component, which may be a mixture of two or more oils, does meet at least one of the requirements described. In some embodiments, the oils are Group II, Group III, or Group IV oils. In other embodiments the compositions of the invention are free of Group I oils. In still other embodiments the compositions of the invention contain less than 10% wt Group I oils.

The invention is focused on improving the wear properties of low sulfur hydraulic fluids. Hydraulic fluids containing Group I base oils typically contain relatively high sulfur levels and so inherently have better wear properties such that the use of the invention is not needed. In contrast, low sulfur hydraulic fluids, such as those containing Group II base oils and similar low sulfur oils, have worse wear properties. The compositions of the invention address this problem and improve the wear properties of such fluids. In some embodiments this improvement is achieved without negatively impacting the demulsibility of the fluid.

Oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydro-treated mineral oil or a synthetic lubricating oil, such as a polyolefin. Examples of useful oils of lubricating viscosity include XHVI base stocks, such as 100N isomerized wax base stock (0.01% sulfur/141 VI), 120N isomerized wax base stock (0.01% sulfur/149 VI), 170N isomerized wax base stock (0.01% sulfur/142 VI), and 250N isomerized wax base stock (0.01% sulfur/146 VI); refined base stocks, such as 250N solvent refined paraffinic mineral oil (0.16% sulfur/89 VI), 200N solvent refined naphthenic mineral oil (0.2% sulfur/60 VI), 100N solvent refined/hydro-treated paraffinic mineral oil (0.01% sulfur/98 VI), 240N solvent refined/hydro-treated paraffinic mineral oil (0.01% sulfur/98 VI), 80N solvent refined/hydro-treated paraffinic mineral oil (0.08% sulfur/127 VI), and 150N solvent refined/hydro-treated paraffinic mineral oil (0.17% sulfur/127 VI). A description of oils of lubricating viscosity occurs in U.S. Pat. No. 4,582,618 (column 2, line 37 through column 3, line 63, inclusive).

In some embodiments the oil used in the compositions of the invention include Chevron™ RLOP, Motiva™ Star and Petro Canada™ Group II oils, as well as mixtures thereof. In other embodiments the oil has a sulfur content of 0 to 50 ppm and/or a viscosity index of up to 130. Suitable oils may be mixtures of two or more oils, including oils with different sulfur contents, viscosity indexes, and our viscosities.

In one embodiment, the oil of lubricating viscosity is a polyalpha-olefin (PAO). Typically, the polyalpha-olefins are derived from monomers having from 4 to 30, or from 4 to 20, or from 6 to 16 carbon atoms. Examples of useful PAOs include those derived from decene. These PAOs may have a viscosity from 3 to 150, or from 4 to 100, or from 4 to 8 cSt at 100° C. Examples of PAOs include 4 cSt polyolefins, 6 cSt polyolefins, 40 cSt polyolefins and 100 cSt polyalphaolefins.

In one embodiment, the lubricating composition contains an oil of lubricating viscosity which has an iodine value of less than 9. Iodine value is determined according to ASTM D-460. In one embodiment, the oil has an iodine value less than 8, or less than 6, or less than 4.

In one embodiment, the oil of lubricating viscosity is selected to provide lubricating compositions with a Kinematic viscosity (KV), as measured by D445, of at least 3.5 cSt, or at least 4.0 cSt at 100° C. In one embodiment, the lubricating compositions have an SAE gear viscosity grade of at least SAE 75W. In other embodiments the lubricating compositions of the present invention have a KV of 30 to 60 cSt at 40 C, or 35 to 46 cSt at 40 C, or about 46 cSt at 40

C. Such embodiments may also have a viscosity index (VI) of 50 to 200, 50 to 150, 75 to 125, or about 100.

The lubricating composition may also have a so-called multigrade rating such as SAE 75W-80, 75W-90, 75W-140, 80W-90, 80W-140, 85W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers previously available from Rohm & Haas which have been integrated into the Viscoplex™ family; Shellvis™ rubbers available from Shell Chemical; Trilene™ polymers, such as Trilene™ CP-40, available commercially from Chemtura, and Lubrizol 3100 series and 8400 series polymers, such as Lubrizol® 3174 available from The Lubrizol Corporation. These additives, as well as additional additives which may be used in the compositions of the invention, are described in more detail in the sections below. In other embodiments the lubricating compositions of the present invention have a KV of 20 to 40 cSt at 40 C, or 25 to 35 cSt at 40 C, or about 32 cSt at 40 C. Such embodiments may also have a viscosity index (VI) of greater than 200, greater than 300, greater than 400, or about 425.

In still other embodiments, the lubricating compositions of the present invention may have a KV of 20 to 100 cSt at 40 C and a VI of 80 to 450 or a KV of 25 to 55 100 cSt at 40 C and a VI of 140 to 180.

In one embodiment, the oil of lubricating viscosity includes at least one ester of a dicarboxylic acid. Typically the esters containing from 4 to 30, preferably from 6 to 24, or from 7 to 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Examples of ester groups include hexyl, octyl, decyl, dodecyl and tridecyl ester groups. The ester groups include linear as well as branched ester groups such as iso arrangements of the ester alkyl group. A particularly useful ester of a dicarboxylic acid is diisodecyl azelate. In some embodiments the oil of lubricating viscosity is substantially free or even free of esters or any one or more of the specific esters described above.

The oil of lubricating viscosity may be present in ranges from 60 to 99.9 wt %, or from 65 to 95 wt %, or from 70 to 85 wt %. In other embodiments the oil of lubricating viscosity is present from 90 to 99.9 wt %, 95 to 99.9 wt %, or 98 to 99.5 wt %.

The lubricating composition may be in the form of a concentrate and/or a fully formulated lubricant. If the lubricating composition of the present invention is in the form of a concentrate (which may be combined with additional oil to form, in whole or in part, a finished lubricant), the ratio of the additives (a) to (d) to the oil of lubricating viscosity and/or to diluent oil include the ranges of about 1:99 to about 99:1 by weight, or from about 80:20 to about 10:90 by weight.

Other Friction Modifiers

Other optional friction modifiers used in the methods and compositions of the present invention may include those additives generally known as friction modifiers and/or lubricity aids. These other friction modifiers would be optionally in addition to the fatty phosphites and fatty imidazolines. A useful list of such other friction modifier additives is included in U.S. Pat. No. 4,792,410. U.S. Pat. No. 5,110,488 discloses metal salts of fatty acids and especially zinc salts, useful as friction modifiers. Fatty acids are also useful friction modifiers. A list of other friction modifiers suitable for invention includes: (i) fatty phosphonates; (ii) fatty acid amides; (iii) fatty epoxides; (iv) borated fatty epoxides; (v) fatty amines; (vi) glycerol esters; (vii) borated glycerol esters; (viii) alkoxylated fatty amines; (ix) borated alkoxylated fatty amines; (x) metal salts of fatty acids; (xi) sulfurized olefins; (xii) condensation products of carboxylic acids or equivalents and polyalkylene-polyamines; (xiii) metal salts of alkyl salicylates; (xiv) amine salts of alkylphosphoric acids; (xv) fatty esters; (xvi) condensation products of carboxylic acids or equivalents with polyols and mixtures thereof.

Representatives of each of these types of friction modifiers are known and are commercially available. For instance, (i) includes components generally of the formulas: $(RO)_2PHO$; (RO)(HO)PHO; and P(OR)(OR)(OR). In these structures, the term "R" is conventionally referred to as an alkyl group but may also be hydrogen. It is, of course, possible that the alkyl group is actually alkenyl and thus the terms "alkyl" and "alkylated," as used herein, will embrace other than saturated alkyl groups within the component. The component should have sufficient hydrocarbyl groups to render it substantially oleophilic. In some embodiments the hydrocarbyl groups are substantially un-branched. Many suitable such components are available commercially and may be synthesized as described in U.S. Pat. No. 4,752,416. In some embodiments the component contains 8 to 24 carbon atoms in each of R groups. In other embodiments the component may be a fatty phosphite containing 12 to 22 carbon atoms in each of the fatty radicals, or 16 to 20 carbon atoms. In one embodiment the fatty phosphite can be formed from oleyl groups, thus having 18 carbon atoms in each fatty radical.

The (iv) borated fatty epoxides are known from Canadian Patent No. 1,188,704. These oil-soluble boron-containing compositions are prepared by reacting, at a temperature from 80° C. to 250° C., boric acid or boron trioxide with at least one fatty epoxide having the formula:

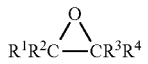

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation.

The (iii) non-borated fatty epoxides, corresponding to "Reagent B" above, are also useful as friction modifiers.

Borated amines are generally known from U.S. Pat. No. 4,622,158. Borated amine friction modifiers (including (ix) borated alkoxylated fatty amines) are conveniently prepared by the reaction of a boron compounds, as described above, with the corresponding amines. The amine can be a simple fatty amine or hydroxy containing tertiary amines. The borated amines can be prepared by adding the boron reactant, as described above, to an amine reactant and heating the resulting mixture at a 50° to 300° C., preferably 100° C. to 250° C. or 130° C. to 180° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene-[10]cocoamine); ETHOMEEN™ S/12 (bis[2-hydroxyethyl]soyamine); ETHOMEEN™ T/12 (bis[2-hydroxyethyl]-tallow-amine); ETHOMEEN™ T/15 (polyoxyethylene-[5]tallowamine); ETHOMEEN™ O/12 (bis[2-hydroxyethyl]oleyl-amine); ETHOMEEN™ 18/12 (bis[2-hydroxyethyl]-octadecylamine); and ETHOMEEN™ 18/25 (polyoxyethylene[15]-octadecylamine). Fatty amines and ethoxylated fatty amines are also described in U.S. Pat. No. 4,741,848. Dihydroxyethyl tallowamine (commercially sold as ENT-12™) is included in these types of amines.

The (viii) alkoxylated fatty amines, and (v) fatty amines themselves (such as oleylamine and dihydroxyethyl tallowamine) are generally useful as friction modifiers in this invention. Such amines are commercially available.

Both borated and unborated fatty acid esters of glycerol can be used as friction modifiers. The (vii) borated fatty acid esters of glycerol are prepared by borating a fatty acid ester of glycerol with boric acid with removal of the water of reaction. Preferably, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, or oil.

The (vi) fatty acid esters of glycerol themselves can be prepared by a variety of methods well known in the art. Many of these esters, such as glycerol monooleate and glycerol tallowate, are manufactured on a commercial scale. The esters useful are oil-soluble and are preferably prepared from C8 to C22 fatty acids or mixtures thereof such as are found in natural products and as are described in greater detail below. Fatty acid monoesters of glycerol are preferred, although, mixtures of mono- and diesters may be used. For example, commercial glycerol monooleate may contain a mixture of 45% to 55% by weight monoester and 55% to 45% diester.

Fatty acids can be used in preparing the above glycerol esters; they can also be used in preparing their (x) metal salts, (ii) amides, and (xii) imidazolines, any of which can also be used as friction modifiers. Preferred fatty acids are those containing 10 to 24 carbon atoms, or 12 to 18. The acids can be branched or straight-chain, saturated or unsaturated. In some embodiments the acids are straight-chain acids. In other embodiments the acids are branched. Suitable acids include decanoic, oleic, stearic, isostearic, palmitic, myristic, palmitoleic, linoleic, lauric, and linolenic acids, and the acids from the natural products tallow, palm oil, olive oil, peanut oil, corn oil, coconut oil and Neat's foot oil. A particularly preferred acid is oleic acid. Preferred metal salts include zinc and calcium salts. Examples are overbased calcium salts and basic oleic acid-zinc salt complexes, such as zinc oleate, which can be represented by the general formula $Zn_4Oleate_6O_1$. Preferred amides are those prepared by condensation with ammonia or with primary or secondary amines such as ethylamine and diethanolamine. Fatty imidazolines are the cyclic condensation product of an acid with a diamine or polyamine such as a polyethylenepolyamine. The imidazolines are generally represented by the structure:

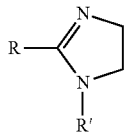

where R is an alkyl group and R' is hydrogen or a hydrocarbyl group or a substituted hydrocarbyl group, including —$(CH_2CH_2NH)$n- groups. In a preferred embodiment the friction modifier is the condensation product of a C10 to C24 fatty acid with a polyalkylene polyamine, and in particular, the product of isostearic acid with tetraethylenepentamine.

The condensation products of carboxylic acids and polyalkyleneamines (xiii) may generally be imidazolines or amides. They may be derived from any of the carboxylic acids described above and any of the polyamines described herein.

Sulfurized olefins (xi) are well known commercial materials used as friction modifiers. A particularly preferred sulfurized olefin is one which is prepared in accordance with the detailed teachings of U.S. Pat. Nos. 4,957,651 and 4,959,168. Described therein is a co-sulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol. Reactant (3), the olefin component, comprises at least one olefin. This olefin is preferably an aliphatic olefin, which usually will contain 4 to 40 carbon atoms, preferably from 8 to 36 carbon atoms. Terminal olefins, or alpha-olefins, are preferred, especially those having from 12 to 20 carbon atoms. Mixtures of these olefins are commercially available, and such mixtures are contemplated for use in this invention. The co-sulfurized mixture of two or more of the reactants, is prepared by reacting the mixture of appropriate reactants with a source of sulfur. The mixture to be sulfurized can contain 10 to 90 parts of Reactant (1), or 0.1 to 15 parts by weight of Reactant (2); or 10 to 90 parts, often 15 to 60 parts, more often 25 to 35 parts by weight of Reactant (3), or 10 to 90 parts by weight of reactant (4). The mixture, in the present invention, includes Reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present invention include elemental sulfur, which is preferred, hydrogen sulfide, sulfur halide plus sodium sulfide, and a mixture of hydrogen sulfide and sulfur or sulfur dioxide. Typically often 0.5 to 3 moles of sulfur are employed per mole of olefinic bonds. Sulfurized olefins may also include sulfurized oils such as vegetable oil, lard oil, oleic acid and olefin mixtures.

Metal salts of alkyl salicylates (xiii) include calcium and other salts of long chain (e.g. C12 to C16) alkyl-substituted salicylic acids.

Amine salts of alkylphosphoric acids (xiv) include salts of oleyl and other long chain esters of phosphoric acid, with amines as described below. Useful amines in this regard are tertiary-aliphatic primary amines, sold under the tradename Primene™.

In some embodiments the friction modifier is a fatty acid or fatty oil, a metal salt of a fatty acid, a fatty amide, a sulfurized fatty oil or fatty acid, an alkyl phosphate, an alkyl phosphate amine salt; a condensation product of a carboxylic acid and a polyamine, a borated fatty epoxide, a fatty imidazoline, or combinations thereof.

In other embodiments the friction modifier may be the condensation product of isostearic acid and tetraethylene pentamine, the condensation product of isostearic acid and 1-[tris(hydroxymethyl)]methylamine, borated polytetradecyloxirane, zinc oleate, hydroxylethyl-2-heptadecenyl imidazoline, dioleyl hydrogen phosphate, C14-C18 alkyl phosphate or the amine salt thereof, sulfurized vegetable oil, sulfurized lard oil, sulfurized oleic acid, sulfurized olefins, oleyl amide, glycerol monooleate, soybean oil, or mixtures thereof.

In still other embodiments the friction modifier may be glycerol monooleate, oleylamide, the reaction product of isostearic acid and 2-amino-2-hydroxymethyl-1,3-propanediol, sorbitan monooleate, 9-octadecenoic acid, isostearyl amide, isostearyl monooleate or combinations thereof.

The amount of other friction modifiers may be 0.01 to 2 wt % or 0.03 to 1 wt % of the lubricating composition, and in some embodiments is 0.05 to 1.5 wt %, 0.05 to 0.5 wt %, 0.08 to 1 wt %, or 0.075 to 0.3 wt %. In some embodiments, however, the amount of friction modifier is present at less than 0.5 percent or less than 0.2 percent by weight, or present from 0.2 to 0.5 percent. In other embodiments the friction modifier is present at more than 500 ppm, more than 1000 ppm, more than 1500 ppm or more than 2000 ppm, but in each of these embodiments the upper limit may be no more than 5000 ppm, no more than 3000 ppm, or no more than 2000 ppm. These ranges may apply to the amounts of individual friction modifier present in the composition or to the total friction modifier component in the compositions, which may include a mixture of two or more friction modifiers.

Many friction modifiers tend to also act as emulsifiers. This is often due to the fact that friction modifiers often have non-polar fatty tails and polar head groups. Emulsibility, or rather decreased demulsibility, is a result that is undesirable in hydraulic fluids, where it is desirable for such compositions to remain separate from and not entrain any water with which the fluid may come into contact. The friction modifiers of the present invention may be used to improve the antiwear performance of the hydraulic fluid, however in some embodiments care must be taken to avoid using the friction modifier at a level that would negatively impact the demulsibility of the fluid.

The compositions of the invention may further include additional additives or additive packages. Many of the additives which may be used are described in greater detail below and these additives may be added separately or as an additive package. Additive packages may contain one or more of the additives described herein and may also contain some amount of diluent oil and/or solvent. An additive package may be added to the compositions of the invention such that they are present at 0.2 to 4.0 wt %, 0.5 to 3.0 wt %, or 0.6 to 2.0 wt %.

Metal Containing Dispersant

The compositions of the invention may optionally contain a metal containing dispersant. The dispersant may be present in ranges from 0 to 5 wt %, or from 0.05 to 2.5 wt %, or from 0.1 to 1.5 wt %. In different embodiments the metal containing dispersant is present at 0.2 wt %, 0.3 wt %, 0.5 wt %, 0.7 wt %, 0.9 wt %, or 1.1 wt %.

The metal of the metal containing dispersant comprises zinc, copper, magnesium, barium or calcium. In one embodiment the metal is zinc.

The dispersant may include N-substituted long chain alkenyl succinimides or long chain alkenyl esters, partial esters or salts thereof.

Examples of N-substituted long chain alkenyl succinimides include polyisobutylene succinimide with number average molecular weight of the polyisobutylene substituent in the range about 350 to about 5000, or about 500 to about 3000.

The long chain alkenyl esters, partial esters or salts thereof may be prepared by reacting an alkenyl substituted acylating agent (such as a polyisobutylene succinic acid) with a polyol.

Examples of a suitable polyol include ethylene glycol, propylene glycol, butylene glycol, pentaerythritol, mannitol, sorbitol, glycerol, di-glycerol, tri-glycerol, tetra-glycerol, erythritol, 2-hydroxymethyl-2-methyl-1,3-propanediol (trimethylolethane), 2-ethyl-2-(hydroxymethyl)-1,3-propanediol (trimethylolpropane), 1,2,4-hexanetriol and mixtures thereof.

The succinimide may be prepared from a polyamine. Suitable polyamines include alkylenediamine, a polyalkylenepolyamine such as a polyethylenepolyamine, or a mixture thereof. Useful examples of polyamines are ethylenediamine, propylenediamine, 1,3-diaminopropane, N-methylethylenediamine, diethylenetriamine, triethylenetetramine, tetraethylenepentamine, tris(2-aminoethyl)amine, and polyethylenepolyamine bottoms (HPAX® amines commercially produced by Dow Chemicals).

In one embodiment the invention further comprises at least one dispersant derived from polyisobutenyl succinic anhydride, an amine and zinc oxide to form a polyisobutylene succinimide complex or salt with a zinc compound or cation. The polyisobutylene succinimide complex with zinc may be used alone or in combination with other dispersants. Methods of preparing polyisobutylene succinimide complex with zinc are described in more detail in U.S. Pat. No. 3,636,603.

The compositions of the invention may also include non-metal containing dispersants. These dispersants can be the N-substituted long chain alkenyl succinimides or long chain alkenyl esters, partial esters thereof described above before the salt formation with the metal takes place. Borated versions and/or other derivatives of any of the dispersants described above may also be used.

Metal Di-Hydrocarbyl Substituted Dithiophosphate

The compositions of the invention may further comprise a metal dihydrocarbyl dithiophosphate. Metal dihydrocarbyl dithiophosphates suitable for use in the invention contain at least one branched hydrocarbyl group. The hydrocarbyl dithiophosphate includes those represented by the formula:

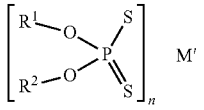

wherein M' comprises a metal; and both $R^1$ and $R^2$ are hydrocarbyl groups or mixtures thereof, with the proviso that at least one of $R^1$ and $R^2$ is a branched primary hydrocarbyl group, or mixtures thereof. In one embodiment both $R^1$ and $R^2$ are branched primary hydrocarbyl groups.

Each branched hydrocarbyl group may contain about 3 to about 20, or about 8 to about 16, or about 8 to about 14 carbon atoms. Examples of a suitable branched hydrocarbyl group include 2-ethylhexyl, iso-octyl, iso-nonyl, iso-decyl, iso-dodecyl, iso-pentadecyl, 2-methyl-1-pentyl, isobutyl, 2-propyl-1-decyl or mixtures thereof. In one embodiment the branched hydrocarbyl group comprises at least one of 2-ethylhexyl, iso-nonyl, iso-decyl, or mixtures thereof.

When only one of $R^1$ and $R^2$ is branched, the non-branched group may be linear alkyl or aryl. In one embodiment both $R^1$ and $R^2$ are branched.

M' is a metal, and n is an integer equal to the available valence of M'. M' is mono- or di- or tri-valent, in one embodiment divalent and in another embodiment a divalent transition metal. In one embodiment M' is zinc. In one embodiment M' is calcium. In one embodiment M' is barium. Examples of a metal hydrocarbyl dithiophosphate include zinc dihydrocarbyl dithiophosphates (often referred to as ZDDP, ZDP or ZDTP).

The metal dihydrocarbyl dithiophosphate may be present in the lubricating composition in ranges from about 0.01 to about 5 wt %, or from about 0.1 to about 2 wt %, or from about 0.2 to about 1 wt %. In different embodiments the metal dihydrocarbyl dithiophosphate is present at about 0.3 wt %, or about 0.5 wt %, or about 0.7 wt %, or about 0.9 wt %.

The compositions of the invention may also include non-metal containing dihydrocarbyl dithiophosphates. These additives can be dihydrocarbyl dithiophosphate esters or partial esters thereof derived from the materials described above before the salt formation with the metal takes place. These additives include dithiophosphoric acid esters.

Additional Additives

The compositions may optionally comprise one or more additives comprising a detergent, an antioxidant, a corrosion inhibitor, or mixtures thereof.

Detergents

The lubricant composition optionally further comprises known neutral or overbased detergents i.e. ones prepared by conventional processes known in the art. Suitable detergent substrates include, phenates, sulfur containing phenates, sulfonate s, salixarates, salicylates, carboxylic acid, phosphorus acid, mono- and/or di-thiophosphoric acid, alkyl phenol, sulfur coupled alkyl phenol compounds, or saligenins. The detergent may be natural or synthetic. In one embodiment the detergent is synthetic.

In one embodiment the detergent comprises a sulfonate detergent. The sulfonate detergent may also have corrosion inhibitor properties.

The sulfonate detergent of the composition includes compounds represented by the formula:

$$(R^1)_k\text{-A-SO}_3\text{M} \quad \text{(I)}$$

wherein each $R^1$ is a hydrocarbyl group in one embodiment containing about 6 to about 40, or from about 8 to about 35, or from about 8 to about 30 carbon atoms; A may be independently a cyclic or acyclic divalent or multivalent hydrocarbon group and is typically aromatic; M is hydrogen, a valence of a metal ion, an ammonium ion or mixtures thereof; and k is an integer of 0 to about 5, for example 0, 1, 2, 3, 4, 5. In one embodiment k is 1, 2 or 3, in another embodiment 1 or 2 and in another embodiment 2.

In one embodiment k is 1 and $R^1$ is a branched alkyl group with about 6 to about 40 carbon atoms. In one embodiment k is 1 and $R^1$ is a linear alkyl group with about 6 to about 40 carbon atoms.

Examples of suitable $R^1$ linear alkyl group include octyl, nonyl, decyl, undecyl, dodecyl, pentadecyl, hexadecyl, eicosyl, or mixtures thereof.

When M is a valence of a metal ion, the metal may be monovalent, divalent, trivalent or mixtures of such metals. When monovalent, the metal M includes an alkali metal such as lithium, sodium, or potassium, and when divalent, the metal M includes an alkaline earth metal such as magnesium, calcium or barium. In one embodiment the metal is an alkaline earth metal. In one embodiment the metal is calcium.

When A is cyclic hydrocarbon group, suitable groups include phenylene or those with fused cyclic groups such as naphthylene, indenylene, indanylene, bicyclopentadienylene or mixtures thereof. In one embodiment A comprises a naphthalene ring.

In different embodiments the detergent is neutral or overbased. In one embodiment the detergent is neutral.

Examples of a suitable detergent include at least one of calcium dinonyl naphthalene sulfonate, calcium didecyl naphthalene sulfonate, didodecyl naphthalene sulfonate, calcium dipentadecyl naphthalene sulfonate, or mixtures thereof. In one embodiment the detergent comprises neutral or slightly overbased calcium dinonyl naphthalene sulfonate, or mixtures thereof.

The detergent may be present in the lubricating composition in ranges from 0 to about 3 wt %, or from about 0.001 to about 1.5 wt %, or from about 0.01 to about 0.75 wt %. In different embodiments the detergent may be present at about 0.08 wt %, or about 0.1 wt %, or about 0.2 wt %, or about 0.4 wt % or about 0.6 wt % of the lubricating composition.

Antioxidant

Antioxidant compounds are known and include alkylated diphenylamines, hindered phenols, molybdenum dithiocarbamates, and mixtures thereof. Suitable antioxidants also include alkylated alpha-phenyl naphthyl amines. Antioxidant compounds may be used alone or in combination with other antioxidants.

Hindered phenol antioxidants often contain a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, or 2,6-di-tert-butylphenol. In one embodiment the hindered phenol antioxidant is an ester and may include, e.g., Irganox™ L-135 from Ciba. Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

Suitable alkylated diphenylamines include bis-nonylated diphenylamine, nonyl diphenylamine, octyl diphenylamine, bis-octylated diphenylamine, di-isobutylated diphenylamine, bis-decylated diphenylamine, decyl diphenylamine, bis-styrenated dipenylamine (that is, bis-phenethylated diphenylamine), styrenated dipenylamine (that is, phenethylated diphenylamine), and mixtures thereof.

The antioxidant may be present in the lubricating composition in ranges from 0 to about 3 wt %, or from about 0.01 to about 1.5 wt %, or from about 0.05 to about 0.8 wt %.

Corrosion Inhibitor

The lubricating composition optionally further comprises a corrosion inhibitor. Examples of a corrosion inhibitor include benzotriazoles, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyl-dithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof. In one embodiment the corrosion inhibitor is benzotriazole. In one embodiment the corrosion inhibitor is a 2,5-bis(alkyl-dithio)-1,3,4-thiadiazole. The corrosion inhibitor may be used alone or in combination with other corrosion inhibitors.

Benzotriazoles may contain hydrocarbyl substitutions on at least one of the following ring positions 1- or 2- or 4- or 5- or 6- or 7-. The hydrocarbyl groups may contain 1 to about 30, or 1 to about 15, or 1 to about 7 carbon atoms. In one embodiment the corrosion inhibitor is tolyltriazole. In one embodiment hydrocarbyl benzotriazoles substituted at positions 4- or 5- or 6- or 7- can be further reacted with an aldehyde and a secondary amine.

Examples of suitable hydrocarbyl benzotriazoles further reacted with an aldehyde and a secondary amine include N,N-bis(heptyl)-ar-methyl-1H-benzotriazole-1-methanamine, N,N-bis(nonyl)-ar-methyl-1H-benzotriazole-1-methanamine, N,N-bis(decyl)-ar-methyl-1H-benzotriazole-1-methanamine, N,N-bis(undecyl)-ar-methyl-1H-benzotriazole-1-methanamine, N,N-bis(dodecyl)-ar-methyl-1H-benzotriazole-1-methanamine, N,N-bis-ethylhexyl)-ar-methyl-1H-benzotriazole-1-methanamine and mixtures thereof. In one embodiment the corrosion inhibitor is N,N-bis(2-ethylhexyl)-ar-methyl-1H-benzotriazole-1-methanamine.

In one embodiment, the corrosion inhibitor is 2,5-bis(alkyl-dithio)-1,3,4-thiadiazoles. The alkyl groups of 2,5-bis(alkyl-dithio)-1,3,4-thiadiazoles contains 1 to about 30, or about 2 to about 25, or 4 to about 20, or about 6 to about 16 carbon atoms. Examples of suitable 2,5-bis(alkyl-dithio)-1,3,4-thiadiazoles include 2,5-bis(tert-octyldithio)-1,3,4-thiadiazole, 2,5-bis(tert-nonyldithio)-1,3,4-thiadiazole, 2,5-bis(tert-decyldithio)-1,3,4-thiadiazole, 2,5-bis(tert-undecyldithio)-1,3,4-thiadiazole, 2,5-bis(tert-dodecyldithio)-1,3,4-thiadiazole, or mixtures thereof.

The corrosion inhibitor may be present in ranges from about 0 to about 1.5, or from about 0.0003 to about 1.5, or from about 0.0005 to about 0.5, or from about 0.001 to about 0.1 weight percent of the lubricating composition.

Viscosity Modifier

The lubricating composition optionally further comprises a viscosity modifier. As used herein the term "(meth)acrylate" includes a methacrylate and/or an acrylate. Viscosity modifiers (often referred to as viscosity index improvers) suitable for use in the invention include polymeric materials including a styrene-butadiene rubber, an olefin copolymer, a hydrogenated styrene-isoprene polymer, a hydrogenated radical isoprene polymer, a poly(meth)acrylic acid ester, a poly(alkylstyrene), an alkenylaryl conjugated-diene copolymer, an ester of maleic anhydride-styrene copolymer or mixtures thereof.

In some embodiments the viscosity modifier is a poly(meth)acrylic acid ester, an olefin copolymer or mixtures thereof.

Poly(meth)acrylic acid ester viscosity modifiers include copolymers of (a) a (meth)acrylic acid ester containing 9 to 30 carbons in the ester group, (b) a (meth)acrylic acid ester containing 7 to 12 carbons in the ester group wherein the ester group contains a 2-($C_{1-4}$ alkyl)-substituent and optionally (c) at least one monomer including a (meth)acrylic acid ester containing from 2 to 8 carbon atoms in the ester group and which is different from the (meth)acrylic acid esters used in (a) and (b) above. In one embodiment the (meth) acrylic acid esters is derived from a methacrylate.

Viscosity modifiers may be derived from an olefin copolymer. The olefin copolymer includes those with a backbone containing 2 to 4 different olefin monomers, in one embodiment 2 to 3 different olefin monomers and in yet another embodiment 2 different olefin monomers. The olefin monomers include 2 to 20, in one embodiment 2 to 10, in another embodiment 2 to 6 and in yet another embodiment 2 to 4 carbon atoms.

The olefin copolymer includes an ethylene monomer and at least one other co-monomer derived from an alpha-olefin having the formula $H_2C{=}CHR^3$, wherein $R^3$ is a hydrocarbyl group, in one embodiment an alkyl radical containing 1 to 18, 1 to 10, 1 to 6 or 1 to 3 carbon atoms. The hydrocarbyl group includes an alkyl radical that has a straight chain, a branched chain or mixtures thereof.

Examples of suitable co-monomers include propylene, 1-butene, 1-hexene, 1-octene, 4-methyl-1-pentene, 1-decene, 1-dodecene, 1-tridecene, 1-tetradecene, 1-pentadecene, 1-hexadecene, 1-heptadecene, 1-octadecene, 1-nonadecene or mixtures thereof. The co-monomer may be 1-butene, propylene or mixtures thereof. Examples of olefin copolymers include ethylene-propylene and ethylene-1-butene copolymers and mixtures thereof.

The viscosity modifiers are present on an oil free basis at of 0 wt % to 30 wt %, 0.1 wt % to 30 wt %, 1 wt % to 25 wt %, 3 wt % to 20 wt % or 5 wt % to 12 wt % of the composition. In one embodiment the viscosity modifier is present. In one embodiment the viscosity modifier is absent.

Optionally the lubricating composition further comprises at least one of rust inhibitors, foam inhibitors, demulsifiers, pour point depressants or mixtures thereof. The total combined amount of foam inhibitors, demulsifiers, pour point depressants may range from 0 to about 10 wt %, or from 0 to about 5 wt %, or from about 0.0001 to about 1 wt % of the lubricating composition.

Rust inhibitors include amine salts of carboxylic acids, such as octylamine octanoate, condensation products of dodecenyl succinic acid or anhydride or a fatty acid, such as oleic acid with a polyamine, e.g. a polyalkylene polyamine such as triethylenetetramine, and half esters of alkenyl succinic acids in which the alkenyl radical contains about 8 to about 24 carbon atoms with alcohols such as polyglycols. Rust inhibitors also include neutral naphthalene sulfonates. The rust inhibitors can be used alone or in combination with other rust inhibitors.

Foam inhibitors including polyacrylates, such as copolymers of ethyl acrylate and 2-ethylhexylacrylate, and optionally vinyl acetate; demulsifiers including polyglycol derivatives, trialkyl phosphates, polyethylene glycols, polyethylene oxides, polypropylene oxides, polyethers and (ethylene oxide-propylene oxide) polymers; pour point depressants including esters of maleic anhydride-styrene, poly(meth)acrylates, polyacrylates or polyacrylamides; may also be used in the lubricant compositions of the invention.

In some embodiments the compositions of the invention may be substantially free of, or free of, zinc, but may contain other metals. In other embodiments the compositions are substantially free of, or free of, all metals such that they may be considered ashless.

INDUSTRIAL APPLICATION

The method and lubricating composition of the invention may be suitable industrial fluids, hydraulic fluids, turbine oils, circulating oils, or combinations thereof. In different embodiments the lubricating composition is suitable for various mechanical devices including industrial systems, hydraulic systems or turbines. In one embodiment the lubricating composition is suitable for a hydraulic system.

In some embodiments the methods and compositions of the invention are used in a hydraulic pump. In one embodiment the pump is a hydraulic piston pump. In one embodiment the pump is a vane pump. In another embodiment the pump is a hydraulic hybrid piston and vane pump.

In one set of embodiments the hydraulic fluid of the invention contains a Group II oil, at least one friction modifier as described above (such as a fatty acid ester), and an additive package containing a zinc containing dispersant, at least one antioxidant, at least one antiwear additive, an antifoam agent, a corrosion inhibitor, and a metal deactivator. Such additive packages may be present at any of the ranges described above, or at 0.8 to 2 wt %. In these embodiments, the hydraulic fluid is a zinc containing monograde formulation.

In another set of embodiments the hydraulic fluid of the invention contains a Group II oil, at least one friction modifier as described above (such as a fatty acid ester), and an additive package containing a viscosity modifier, at least one antioxidant, an antifoam agent, an antiwear agent, a corrosion inhibitor, and a metal deactivator. Such additive packages may be present at any of the ranges described above, or at 0.4 to 1.5 wt %. In such embodiments, the hydraulic fluid is an ashless/zinc-free multigrade formulation.

EXAMPLES

The following examples provide an illustration of the invention. These examples are non exhaustive and are not intended to limit the scope of the invention.

Piston Pump Testing

Comparative Example 1

A hydraulic fluid composition is prepared by adding Additive Package A to Petro Canada™ Group II oil at a level of 1.62 wt %. Additive Package A contains a zinc containing dispersant derived from polyisobutylene succinic anhydride, a dialkyldiphenylamine antioxidant, a hindered phenol antioxidant, a zinc dialkyl dithiophosphate, an antifoam agent, a corrosion inhibitor, and a metal deactivator. Petro Canada™ Group II oil is essentially sulfur free.

Comparative Example 2

A hydraulic fluid composition is prepared by adding Additive Package B to ExxonMobil™ Esso Asia Pacific/Europe Group I oil at a level of 0.85 wt %. Additive Package B contains a polyisobutylene succinic anhydride dispersant, an alkyl phenol antioxidant, a zinc alkyl dithiophosphate antioxidant, a detergent, an antifoam agent, a metal deactivator, a corrosion inhibitor, and a demulsifier. ExxonMobil™ Esso Asia Pacific/Europe Group I oil has a sulfur content of 3500-4000 ppm.

Comparative Example 3

A hydraulic fluid composition is prepared according to the procedure of Comparative Example 2 except that the ExxonMobil™ Esso Asia Pacific/Europe Group I oil is replaced with Petro Canada™ Group II oil. Petro Canada™ Group II oil is essentially sulfur free.

Example 1

A hydraulic fluid composition is prepared by adding 5000 ppm of glycerol monooleate to Motiva™ Star Group II oil. No other additives are added. Motiva™ Star Group II oil contains about 9 ppm sulfur.

Example 2

A hydraulic fluid composition is prepared by adding 1000 ppm of glycerol monooleate to Motiva™ Star Group II oil. No other additives are added.

Example 3

A hydraulic fluid composition is prepared by adding 500 ppm of glycerol monooleate to the composition of Comparative Example 1.

Example 4

A hydraulic fluid is prepared by adding 1000 ppm of glycerol monooleate to the composition of Comparative Example 1.

Example 5

A hydraulic fluid is prepared by adding 1000 ppm of the condensation product of isostearic acid and tetraethylene pentamine to the composition of Comparative Example 1.

Example 6

A hydraulic fluid is prepared by adding 1000 ppm of oleyl amide to the composition of Comparative Example 1.

The examples and baselines of non-additized Group I and Group II oils are tested in a piston pump screening test intended to correlate to Parker Denison procedure A-TP-30533, published by Parker Denison Hydraulics.

The test method utilizes a standard piston pump operated at 4000 psi, and 140° C. for 24 hours. The baselines tested are the ExxonMobil™ Group I oil used in Comparative Example 3 which has a sulfur content of 3500-4000 ppm and Petro Canada™ Group II oil, which is essentially sulfur free. The testing is carried out. The results of the testing are summarized in the table below. Where repeats are completed both results are reported.

TABLE 1

| Piston Pump Screen Testing | |
|---|---|
| Example ID | Test Result[1] Total Piston Loss (mg) |
| Group I Oil Baseline | 427 - FAIL |
| Group II Oil Baseline | 3342 - FAIL |
| Comparative Example 1 | 645 - FAIL and 2338 - FAIL[2] |
| Comparative Example 2 | 24 - PASS |
| Comparative Example 3 | 403 - FAIL |
| Example 1 | 62 - PASS |
| Example 2 | 136 - PASS |
| Example 3 | 406 - FAIL[3] |
| Example 4 | 43 - PASS |
| Example 5 | 285 - PASS |
| Example 6 | 224 - PASS |

[1]A passing result in this test is a total piston weight loss of 300 mg or less.

[2]The difference in the failing results for comparative example 1 is not unusual as the test measures the wear on the piston pump surfaces after the test. A failing test causes part wear that often deteriorates quickly once passing the 300 mg failure limit.

[3]Example 3 uses the same base oil and additive package as Comparative Example 1. While the result is still a fail, Example 3 shows an improvement in the wear test result over Comparative Example 1.

The results show the significant difference in wear performance of Group I based and Group II based hydraulic fluids and the need for improved wear performance in Group II based fluids and fluids with similar sulfur contents. Group I based hydraulic fluids have significantly better wear properties presumably due to their high sulfur contents as demonstrated by Comparative Example 2. As various environmental and regularity limits result in the reduction of base oil sulfur levels, and the move to more Group II based and similar hydraulic fluid, antiwear performance becomes more of an issue.

The results also show that the addition of a friction modifier, such as glycerol monooleate, can significantly improve the antiwear performance (reduce the wear) delivered by a hydraulic fluid.

Demulsibility Testing

Example 7

A hydraulic fluid composition is prepared by adding Additive Package A, as described in Comparative Example 1 above, to Motiva Star Group II oil at a level of 1.62 wt %. The fluid is then divided into three portions and each is treated with a different level of glycerol monooleate, one at 500 ppm, one at 1000 ppm, and one at 5000 ppm.

Example 8

A hydraulic fluid composition is prepared by adding Additive Package A, as described in Comparative Example 1 above, to Motiva Star Group II oil at a level of 1.62 wt %. The fluid is then divided into three portions and each is treated with a different level of the condensation product of isostearic acid and tetraethylene pentamine, one at 500 ppm, one at 1000 ppm, and one at 5000 ppm.

Example 9

A set of hydraulic fluid compositions are prepared according to Example 8 except that Additive Package A is present at a level of 1.42 wt % and the individual samples are treated with the friction modifier at 500 ppm, 1000 ppm, and 2500 ppm.

Example 10

A set of hydraulic fluid compositions are prepared according to Example 9 except the friction modifier is hydroxyethyl-2-heptadecenyl imidazoline.

Example 11

A set of hydraulic fluid compositions are prepared according to Example 9 except the friction modifier is dioleyl hydrogen phosphite.

Example 12

A set of hydraulic fluid compositions are prepared according to Example 9 except the friction modifier is oleyl amide.

Example 13

A set of hydraulic fluid compositions are prepared according to Example 9 except the friction modifier is C14-C18 alkyl phosphate amine salt and the individual samples are treated with the friction modifier at 500 ppm, and 1000 ppm.

Example 14

A set of hydraulic fluids are prepared according to Example 13 except the friction modifier is tallow amine-2-ethoxylate.

Example 15

A set of hydraulic fluids are prepared according to Example 9 except that a modified version of Additive Package A is used which is identical to Additive Package A described above except that it contains a smaller amount of zinc dialkyl dithiophosphate and also contains a small amount of polyisobutylene succinic anhydride. All of the samples are top treated with 40 ppm of a polyether demulsifier and the friction modifier used is glycerol monooleate. The individual samples are treated with the friction modifier at 1000 ppm, 1500 ppm, 2000 ppm and 3000 ppm.

Example 16

A set of hydraulic fluids are prepared according to Example 15 except that the polyether demulsifier is present in all samples at 100 ppm.

The Examples are tested to evaluate their demulsibility properties. Samples were tested according to ASTM D1401 water separation test protocol, with tests of 80 mL samples carried out at 54.4° C. and results reported as a series of numbers: XX-YY-ZZ (min), with the first number (XX) representing the amount of oil phase, the second number (YY) representing the amount of water phase, and the third number (ZZ) representing the amount of any emulsion phase present. These values are mL readings of the 80 mL test sample. The final number in parenthesis is the time in minutes when the readings were taken. The reading of a sample is taken after mixing when complete separation of the water and oil phases occurs and no emulsion phase is present; however, if an any amount of emulsion phase is still present at 15 minutes, the reported reading is taken when 3 ml or less of an emulsion phase is present; if there is still more than 3 ml of emulsion phase at 30 minutes, the reading is taken at 30 minutes and the test is ended. The sample formulations and test results are summarized in the tables below. The Sample ID provides information on the formulation tested and identify of the friction modifier (FM) present. The columns then show results at various treatment levels of the friction modifier. Several samples were repeated. Where repeats were completed both readings are reported in the table below.

TABLE 2

Demulsibility Testing

| Sample ID | FM at 0 ppm | FM at 500 ppm | FM at 1000 ppm | FM at 2500 ppm | FM at 5000 ppm |
|---|---|---|---|---|---|
| Ex 7 | 40-40-00 (15) | 39-40-01 (15) 38-39-03 (25) | 40-40-00 (10) | | 01-19-60 (30) |
| Ex 8 | 40-40-00 (15) | 01-00-79 (30) | 03-00-77 (30) | | 12-00-68 (30) |
| Ex 9 | | 39-39-02 (20) | 39-39-02 (15) 40-40-00 (20) | 40-40-00 (30) | |
| Ex 10 | | 42-38-00 (05) | 41-39-00 (05) | 40-40-00 (15) | |
| Ex 11 | | 41-38-01 (05) | 40-40-00 (10) | 00-06-74 (30) | |
| Ex 12 | | 40-40-00 (10) | 40-40-00 (15) 40-40-00 (30) | 39-40-01 (30) | |
| Ex 13 | | 01-00-79 (30) | 01-07-72 (30) | | |
| Ex 14 | | 30-20-30 (30) | 32-23-25 (30) | | |

TABLE 3

Demulsibility Testing

| Sample ID | FM at 1000 ppm | FM at 1500 ppm | FM at 2000 ppm | FM at 3000 ppm |
|---|---|---|---|---|
| Ex 15 | 42-38-00 (10) | 43-37-00 (25) | 43-37-00 (20) | 25-34-31 (30) |
| Ex 16 | 14-29-37 (30) | 43-37-00 (30) | 43-37-00 (25) | 11-33-36 (30) |

The results show that the compositions of the present invention have acceptable demulsibility properties at various treat rates of various friction modifiers. The methods and compositions of the invention provide improved wear performance while maintaining acceptable demulsibility properties.

Example 17

Typically the presence of friction modifiers impact critical fluid properties of hydraulic fluids. Hydraulic motor efficiency, wear and demulsibility characteristics of prototype, friction modifier containing, fluids were tested.

A set of inventive hydraulic fluids were prepared according to the table below. Also included in the table is a comparative hydraulic fluid which does not include a friction modifier as well as two hydraulic fluids which include a friction modifier other than a fatty (alkyl) phosphite or an alkenyl imidazoline friction modifier. More specifically, comparative oil 1 was a fully formulated Group III hydraulic oil (see Table 4) not containing any friction modifier. The four friction modifiers tested were dioleyl hydrogen phosphite, alkenyl imidazoline which is 1-hydroxyethyl-2-heptadecenyl imidazoline, carboxylic acid ester which is derived from a hydroxyl carboxylic acid, and commercial grade glycerol monooleate (GMO).

TABLE 4

Comparative And Inventive Hydraulic Oil Compositions

| | Example Type | | | | |
|---|---|---|---|---|---|
| | Comparative 1 | Comparative 2 | Comparative 3 | Inventive 1 | Inventive 2 |
| Group III basestock wt. % | Balance | Balance | Balance | Balance | Balance |
| Group I basestock wt. % | 7.7 | 7.7 | 7.7 | 7.7 | 7.7 |
| Friction modifier type | None | Carboxylic acid ester | GMO | Alkyl phosphite | Alkenyl imidazoline |
| Friction modifier wt. % | 0 | 0.2 | 0.2 | 1.0 | 0.2 |
| VI Improver wt. % (Viscoplex 8-219) | 5.5 | 5.5 | 5.5 | 5.5 | 5.5 |
| Additive package wt. % | 1.6 | 1.6 | 1.6 | 1.6 | 1.6 |
| Pour point depressant wt. % | 0.3 | 0.3 | 0.3 | 0.3 | 0.3 |
| Antifoam additive wt. % | 0.02 | 0.02 | 0.02 | 0.02 | 0.02 |

The above inventive and comparative hydraulic fluids were tested in a full scale, motorized test rig equipped with a hydraulic pump and motor using a rigorous ISO standardized test procedure (ISO 4392-1 and ISO 4392-2). Multiple hydraulic motor designs (geroler, axial piston and radial piston) were tested. All motors demonstrated an energy efficiency benefit when the inventive hydraulic fluids (including fatty (alkyl) phosphite or alkenyl imidazoline friction modifiers) were used. Importantly the benefit was observed for a radial piston motor that in a published academic study (see http://hydraulicspneumatics.com/site-files/hydraulicspneumatics.com/files/uploads/2012/10/Michael-PerformanceComparisonHydraulicFluids.pdf) only responded to base stock chemistry, and not the additives (including friction modifiers).

Figure 2:
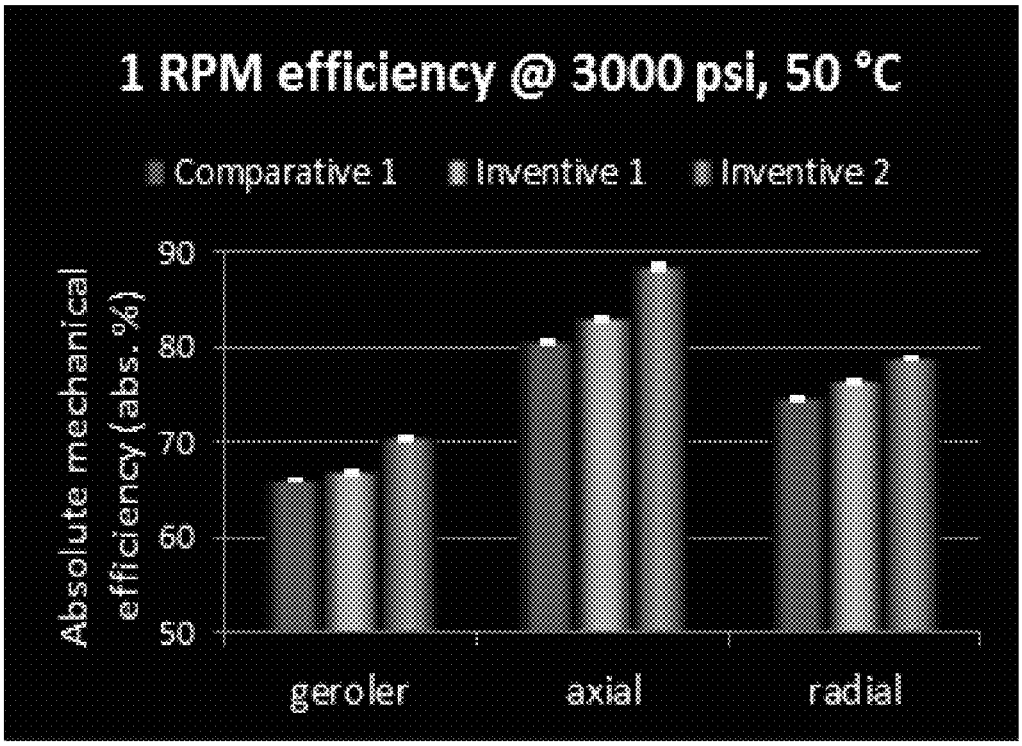
FIG. 2 depicts the measured absolute 1 RPM running efficiency for 3 different hydraulic motors at 50 degrees C. with 2 inventive friction modifiers and a comparative reference with no friction modifier.

FIG. 1 depicts the measured absolute starting efficiency for 3 different hydraulic motors at 50 degrees C. with 3 different hydraulic fluids (one with no friction modifier (Comparative 1) and two with inventive friction modifiers (fatty (alkyl) phosphite (Inventive 1) and alkenyl imidazoline (Inventive 2)). FIG. 2 depicts the measured absolute 1 RPM running efficiency for 3 different hydraulic motors at 50 degrees C. with 3 different hydraulic fluids (one with no friction modifier (Comparative 1) and two with friction modifiers (fatty (alkyl) phosphite (Inventive 1) and alkenyl imidazoline (Inventive 2)). The observed improvement of start-up efficiency depicted in FIG. 1 for the inventive hydraulic fluids is significant and important to OEMs and end users of hydraulic systems.

Figure 3:
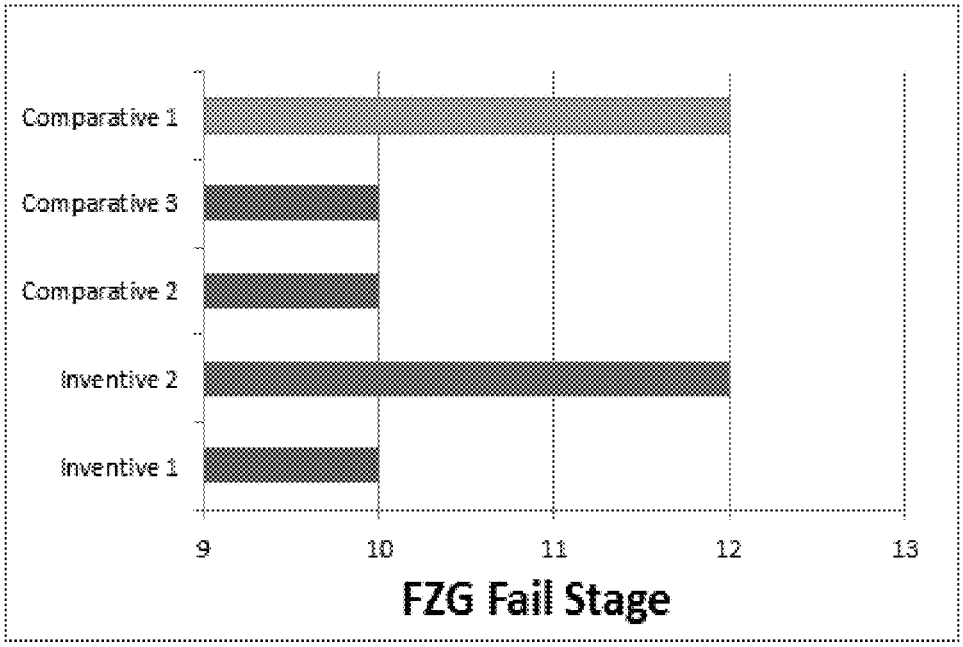
FIG. 3 depicts the results of measurements of FZG load stage for a reference comparative hydraulic oil (with no friction modifier) and four experimental hydraulic oils (the same reference additized with 0.2 wt. % of 4 different friction modifiers (2 comparative and 2 inventive)).

FIG. 3 depicts the results of measurements of FZG load stage (wear measurement test) for the three comparative hydraulic oils and the two inventive hydraulic oils of Table 4. It can be seen in FIG. 3 that the alkyl phosphite friction modifier in the hydraulic fluid at 1.0 wt. % gives low FZG fail stage performance (poor wear performance) while the alkenyl imidazoline at 0.2 wt. % gives high FZG fail stage performance (good wear performance). In wear tests no negative impact of one of the friction modifiers—alkenyl imidazoline—was observed in FIG. 3. Normally, when a friction modifier, such as glycerol monooleate is used, competition between the friction modifier and antiwear additives results in increased wear. This positive characteristic of the alkenyl imidazoline was observed in both FZG load stage (FIG. 3) and 35VQ vane pump test. Both alkyl phosphite and alkenyl imidazoline friction modifiers passed demulsibility tests, even at a high concentration of 1 wt. %. As noted from FIGS. 1-3, not all friction modifiers perform equivalently in hydraulic applications in terms of start-up efficiency, running efficiency and wear performance.

In this specification the terms "hydrocarbyl substituent" or "hydrocarbyl group," as used herein are used in its ordinary sense, which is well-known to those skilled in the art. Specifically, it refers to a group primarily composed of carbon and hydrogen atoms and is attached to the remainder of the molecule through a carbon atom and does not exclude the presence of other atoms or groups in a proportion insufficient to detract from the molecule having a predominantly hydrocarbon character. In general, no more than two, preferably no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is described in U.S. Pat. No. 6,583,092.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about". Unless otherwise indicated all percent values on weight percents and all ppm values are on a weight to weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for improving the starting efficiency of a low-speed high-torque (LSHT) radial piston type hydraulic motor requiring a hydraulic oil composition, the method comprising:

supplying the low-speed high-torque (LSHT) radial piston type hydraulic motor with a hydraulic oil composition comprising:

(a) about 83.9 to 84.7 wt % of a Group III base stock and about 7.7 wt % of a Group I base stock; and (b) a fatty alkyl phosphite friction modifier at about 1.0 wt %, an alkenyl imidazoline friction modifier at about 0.2 wt % or combinations thereof, and (c) other lubricating oil additives comprising the balance of the hydraulic oil composition;

measuring the absolute starting efficiency at 50 deg. C. of the radial piston type hydraulic motor per ISO test procedure ISO 4392-1 and ISO 4392-2, wherein the hydraulic oil composition results in at least a 2% increase in measured absolute starting efficiency of the low-speed high-torque (LSHT) radial piston type hydraulic motor relative to the same hydraulic oil composition not including the effective amount of the friction modifier.

2. The method of claim 1 wherein the fatty alkyl phosphite is dioleyl hydrogen phosphite.

3. The method of claim 1 wherein the alkenyl imidazoline is 1-hydroxyethyl-2-heptadecenyl imidazoline.

4. The method of claim 1 wherein component (a) has a sulfur content of less than 1000 ppm.

5. The method of claim 1 wherein the hydraulic oil composition results in at least a 5% increase in measured absolute starting efficiency of the low-speed high-torque (LSHT) radial piston type hydraulic motor relative to the same hydraulic oil composition not including the effective amount of the friction modifier.

6. The method of claim 1 wherein the hydraulic oil composition results in at least a 10% increase in measured absolute starting efficiency of the low-speed high-torque (LSHT) radial piston type hydraulic motor relative to the same hydraulic oil composition not including the effective amount of the friction modifier.

7. The method of claim 3 wherein the hydraulic oil composition results in wear performance as measured by the FZG load stage test substantially the same as the same hydraulic oil composition not including the 1-hydroxyethyl-2-heptadecenyl imidazoline friction modifier.

8. The method of claim 1 wherein the hydraulic oil composition further results in improved demulsibility of the hydraulic oil composition with water.

9. The method of claim 1 wherein the other lubricating oil additives comprises a dispersant, an antioxidant, a corrosion inhibitor, a carboxylic acid or anhydride, or combinations thereof.

10. The method of claim 1 wherein the other lubricating oil additives comprises a detergent, an antiwear agent, an antifoam, a metal deactivator, a demulsifier, a detergent stabilizer, or combinations thereof.

11. The method of claim 1 wherein the hydraulic oil composition further comprises a metal di-hydrocarbyl-substituted dithiophosphate, wherein at least one hydrocarbyl group is a branched primary hydrocarbyl group.

12. The method of claim 1 wherein the hydraulic oil composition further comprises a metal-free di-hydrocarbyl-substituted dithiophosphate, wherein at least one hydrocarbyl group is a branched primary hydrocarbyl group.

13. The method of claim 1 wherein the hydraulic oil composition is prepared by adding the friction modifier as an aftermarket treatment to the one or more oils of lubricating viscosity.

* * * * *